US010002591B2

(12) United States Patent
Heo et al.

(10) Patent No.: US 10,002,591 B2
(45) Date of Patent: Jun. 19, 2018

(54) DISPLAY DEVICE AND IMAGE RENDERING METHOD THEREOF

(71) Applicant: LG DISPLAY CO., LTD., Seoul (KR)

(72) Inventors: Cheon Heo, Paju-si (KR); Seungyong Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 332 days.

(21) Appl. No.: 14/982,378

(22) Filed: Dec. 29, 2015

(65) Prior Publication Data

US 2017/0098432 A1 Apr. 6, 2017

(30) Foreign Application Priority Data

Oct. 5, 2015 (KR) ..... 10-2015-0140013

(51) Int. Cl.

| | |
|---|---|
| ***G09G 5/22*** | (2006.01) |
| ***G09G 3/20*** | (2006.01) |
| ***G09G 5/02*** | (2006.01) |

(52) U.S. Cl.

CPC ..... *G09G 5/227* (2013.01); *G09G 3/2003* (2013.01); *G09G 3/2074* (2013.01); *G09G 3/2092* (2013.01); *G09G 5/026* (2013.01); *G09G 2300/0452* (2013.01); *G09G 2300/0469* (2013.01); *G09G 2340/0457* (2013.01); *G09G 2340/06* (2013.01); *G09G 2340/10* (2013.01)

(58) Field of Classification Search

CPC ..... G09G 3/2003; G09G 5/227; G09G 5/391; G09G 2340/0407; G09G 2340/0457

See application file for complete search history.

(56) References Cited

U.S. PATENT DOCUMENTS

| | | | | |
|---|---|---|---|---|
| 2004/0085333 | A1* | 5/2004 | Yim | G09G 5/04 345/698 |
| 2006/0147128 | A1* | 7/2006 | Kondo | G06T 1/00 382/300 |
| 2007/0076127 | A1* | 4/2007 | Abe | H04N 9/68 348/645 |

* cited by examiner

*Primary Examiner* — Michael Faragalla
*Assistant Examiner* — Chayce Bibbee
(74) *Attorney, Agent, or Firm* — Dentons US LLP

(57) ABSTRACT

Disclosed is a display device and an image rendering method thereof in consideration of a saturation of a text image that improves the legibility of the text image by, for example, adjusting a sub-pixel rendering application ratio and a direct rendering application ratio for pixel data using a weight in proportion to a saturation.

9 Claims, 9 Drawing Sheets

< Sub-pixel rendering >

< Direct rendering >

< Sub-pixel rendering >

< Direct rendering >

DISPLAY DEVICE AND IMAGE RENDERING METHOD THEREOF

This application claims the benefit of Korean Patent Application No. 10-2015-0140013 filed on Oct. 5, 2015, the entire contents of which is incorporated herein by reference for all purposes as if fully set forth herein.

BACKGROUND OF THE INVENTION

Field of the Invention

The present invention relates to a display device and an image rendering method thereof in consideration of a saturation of a text image.

Discussion of the Related Art

Flat panel display devices such as a liquid crystal display (LCD), an organic light emitting diode (OLED) display, a field emission display (FED) and a plasma display panel (PDP) are known.

A rendering algorithm converts data of an input image into data suitable for the pixel arrangement and structure of a display panel when the resolution of the input image differs from the physical resolution of the display panel. Such a rendering algorithm is applied to display devices.

When the resolution of an input image is different from the resolution of the display device, the quality of an image reproduced by the display device may deteriorate. It may not be difficult to process the input image into a high resolution image without loss of picture quality. However, when the resolution of the input image is converted into a lower resolution image matching the physical resolution of the display device, and the input image is reproduced with the converted resolution through the display device, a data distortion or loss may occur and thus, the picture quality may deteriorate.

Particularly, when a text in the input image is reproduced through a display device having a lower resolution than the input image, text legibility may deteriorate due to an omission or distortion of the data constituting the text. Various rendering algorithms have been proposed in order to enhance text legibility when the resolution of the display device is lower than that of the input image. The applicant proposed a rendering algorithm for improving text legibility in consideration of a difference between neighboring pieces of data when the resolution of a display device is lower than that of an input image (Korea Patent Application 10-2013-0139770 filed on 2013 Nov. 18).

When a text data is converted using conventional rendering algorithms, the legibility of the text data may deteriorate. Particularly, conventional rendering algorithms typically do not consider the saturation of text, focusing on an achromatic text data. Accordingly, the legibility of chromatic data may further deteriorate when conventional rendering algorithms are applied.

SUMMARY OF THE INVENTION

Accordingly, the present invention is directed to a display device and an image rendering method thereof that substantially obviate one or more problems due to limitations and disadvantages of the related art.

An advantage of the present invention is to provide a display device with improved legibility of text image.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device may, for example, include a display panel in which data lines intersect scan lines and pixels are arranged in a matrix form, an image rendering device for calculating saturation of each piece of pixel data of an input image, adjusting a sub-pixel rendering application ratio and a direct rendering application ratio for the pixel data using a weight in proportion to the saturation and converting the pixel data, and a display panel driving circuit for writing data converted by the image rendering device to the pixels of the display panel.

Sub-pixel rendering adjusts values of input image pixel data related to a pixel according to an area ratio of the pixel, sums the pixel data values and converts the pixel data into data to be written to the pixel.

Direct rendering selects pixel data having a center point closest to the center point of the pixel from among the pixel data and converts the selected pixel data into data to be written to the pixel.

The direct rendering application ratio is decreased by a sub-pixel rendering application ratio increase, and the sub-pixel rendering application ratio is reduced by a direct rendering application ratio increase.

In another aspect of the present disclosure, an image rendering method of a display device includes calculating a saturation of each piece of pixel data of an input image, adjusting a sub-pixel rendering application ratio and a direct rendering application ratio for the pixel data using a weight in proportion to the saturation and converting the pixel data.

In yet another aspect of the present disclosure, a display device may, for example, include a display panel in which a plurality of data lines cross a plurality of scan lines to define a plurality of pixels arranged in a matrix; an image rendering circuit that receives a plurality of pixel data of an input image, determines whether the input image is closer to a chromatic data or an achromatic data, and adjusts a ratio of a sub-pixel rendering application or a ratio of a direct rendering application based on a result of the determination and converts the plurality of pixel data into a plurality of display data; and a display panel driving circuit that writes the plurality of display data into the plurality of pixels of the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts. In the following description, a detailed description of known functions and configurations incorporated herein will be omitted when it may obscure the subject matter of the present invention.

A display device according to an embodiment of the present invention may be implemented as a flat panel display, such as a liquid crystal display (LCD), an organic light emitting diode (OLED) display, a plasma display panel (PDP) and a field emission display (FED). While the following embodiments will be described with an LCD, the present invention is not limited thereto.

To express colors, a pixel data includes a red sub-pixel data R, a green sub-pixel data G and a blue sub-pixel data B. When such a pixel data is rendered to correspond to a pixel structure of a display device, an amount of loss of an achromatic pixel data is relatively small since the achromatic pixel data is typically present in each of colors R, G and B. On the other hand, in the case of an chromatic data, a data value difference between colors is large or a data of a certain color may not be present and thus, be processed as a black grayscale data. As a result, when a chromatic data value is converted through a rendering, a line-shaped edge in the text may be seen as dots due to a black grayscale data, and thus, the legibility of the text composed of a chromatic data may deteriorate.

A rendering method according to an embodiment of the present invention is to reduce a data loss by analyzing a degree of saturation of a text data corresponding to an input image and increasing a sub-pixel rendering application ratio for a high-saturation data, and improve the legibility of both chromatic and achromatic texts by increasing a direct rendering application ratio for a low-saturation data.

A sub-pixel rendering method will be described with reference to FIG. 1 and a direct rendering method will be described with reference to FIG. 2.

Figure 3:
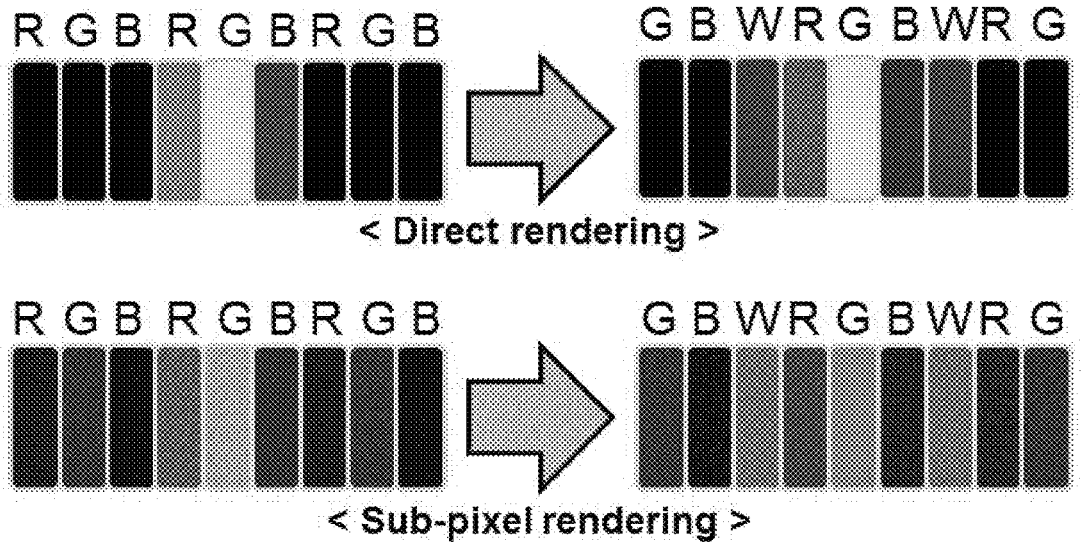
FIG. 3 illustrates examples of rendering original image data in an RGB pixel structure into data suitable for an RGBW pixel structure through the sub-pixel rendering method and the direct rendering method.
Figure 4:
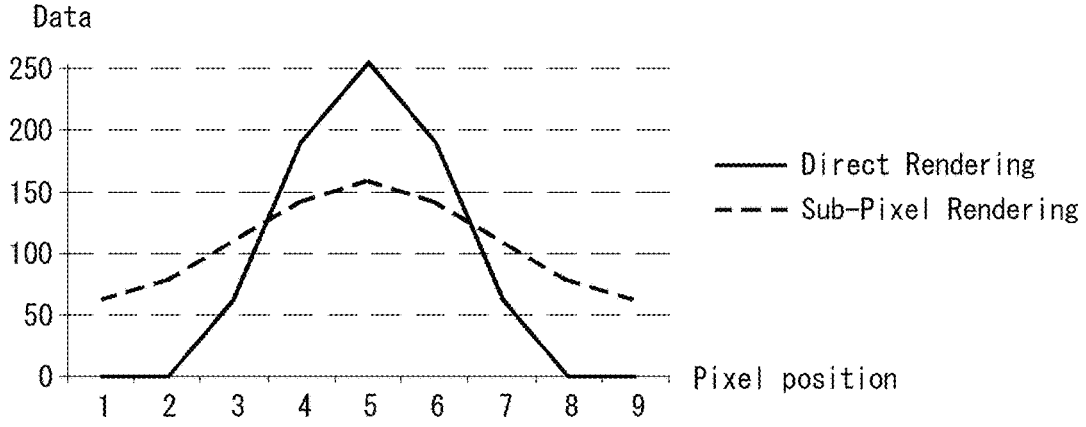
FIG. 4 shows comparison between the sub-pixel rendering method and the direct rendering method for the original image data shown in FIG. 3.

A rendering method according to an embodiment of the present invention is to increase the legibility of a text rendered when an RGB pixel data is converted into an RGBW pixel data, as illustrated in FIGS. 3 and 4. The RGB pixel data includes a red sub-pixel data R, a green sub-pixel data G and a blue sub-pixel data B. The RGBW pixel data includes a red sub-pixel data R, a green sub-pixel data G, a blue sub-pixel data B and a white data W. In addition, the rendering method can improve text legibility when the resolution of a display device is lower than the resolution of an input image.

Figure 1:
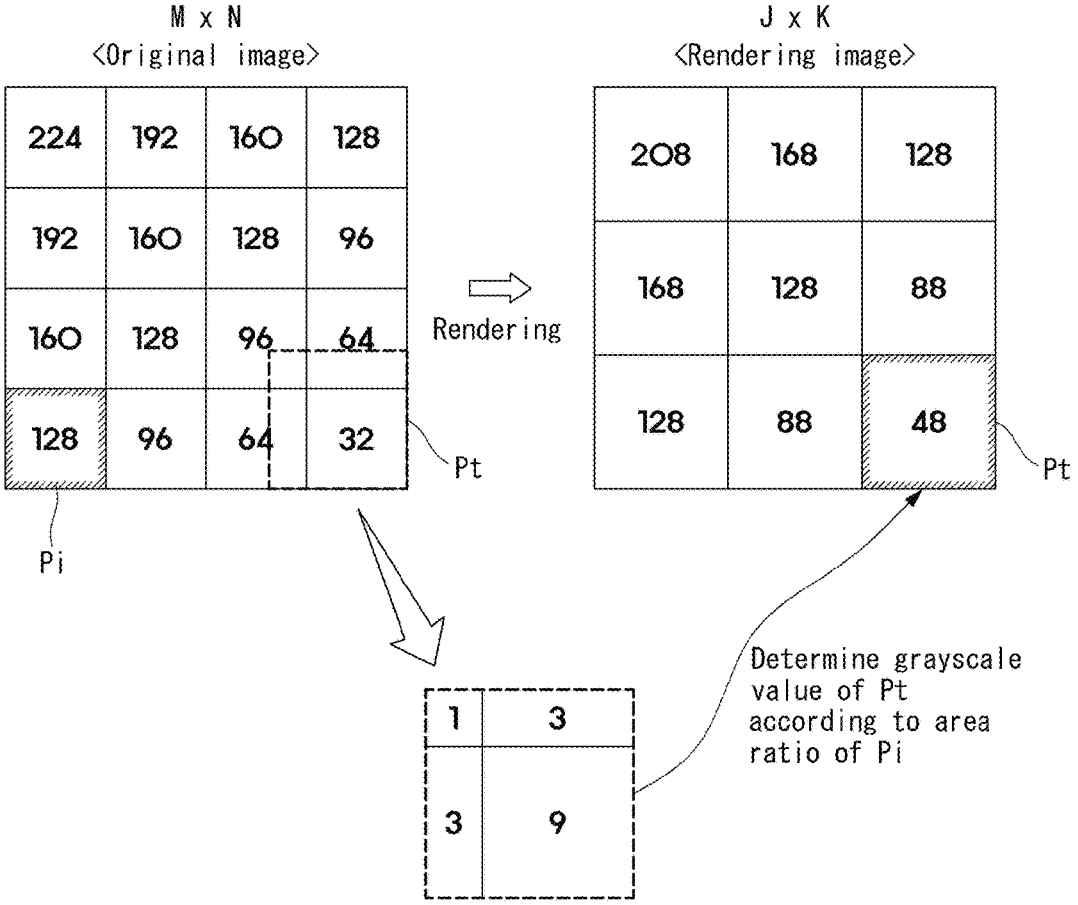
FIG. 1 illustrates a sub-pixel rendering method.

Referring to FIG. 1, a sub-pixel rendering method according to an embodiment of the present invention is used to convert an original image (input image) having a first resolution M×N into a rendering image (display image) having a second resolution J×K, which is lower than the first resolution M×N. M×N refers to a number of pixel data arranged in a matrix, and each of M and N is a positive integer equal to or greater than 2. The original image data includes M×N input pixel data Pi.

The image (referred to as "converted image" hereinafter) in the second resolution J×K is a display image data that is converted to correspond to a pixel structure or a resolution J×K of the display device and is to be reproduced through the display device. J×K refers to a number of pixel data arranged in a matrix. Also, J is a positive integer equal to or greater than 2 and less than M, and K is a positive integer equal to or greater than 2 and less than N. The converted image data includes J×K target pixel data Pt. The target pixel data Pt are written into respective pixels of the display device.

When the input image data Pi are converted in accordance with a screen size of the display device, and when the pixel data Pi of the input image are mapped to the pixels of the display device, more than one input image pixels related to a target pixel (one pixel) overlap due to a difference in the number of pixels between the input image and the display device. An area ratio of the input image data for one target pixel may vary. The sub-pixel rendering method calculates an area ratio of each of the more than one input pixel data Pi related to the target pixel data Pt in order to determine a value (or grayscale) of the target pixel data Pt.

The sub-pixel rendering method multiplies the area ratios of the input pixel data Pi for the target pixel data Pt by values of the input pixel data Pi and divides the result by the sum of the area ratios. For example, the value of the target pixel data Pt is obtained by respectively multiplying the area ratios, 9:3:3:1, of the input pixels related to the target pixel data Pt by values 32, 64, 64 and 96 of the input pixel data Pi, summing the multiplication results and dividing the result by the sum of the area ratios, 16, {(32*9+64*3+64*3+96*1)/16}.

Figure 2:
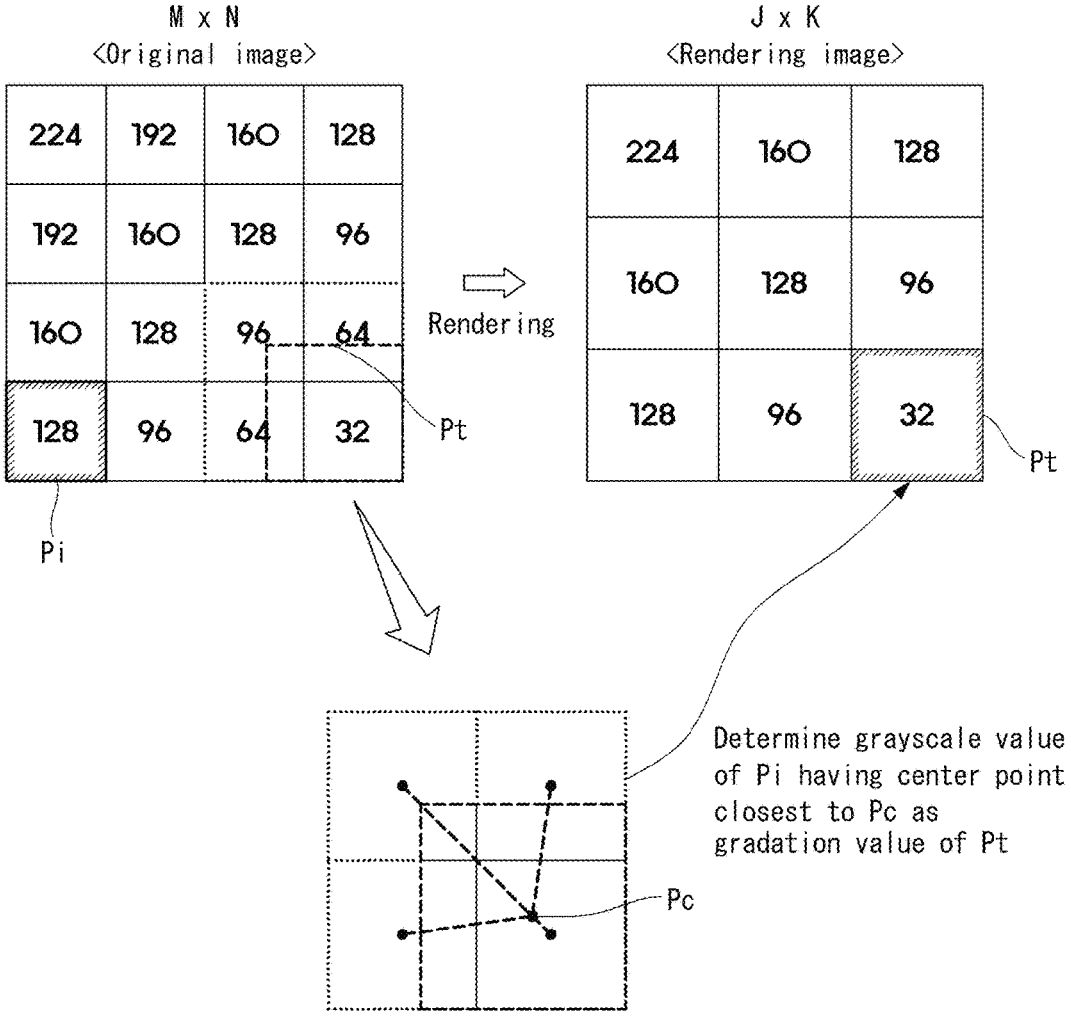
FIG. 2 illustrates a direct rendering method.

Referring to FIG. 2, a direct rendering method also converts the original image to correspond to a pixel structure or a resolution of a display device.

The direct rendering method determines a target pixel data Pt by selecting a data value of an input image pixel of which center point is closest to a center point Pc of the target pixel from among the more than one input pixel data Pi that overlap and are related to the target pixel data Pt.

FIG. 3 shows examples in which an original image data having an RGB pixel structure is rendered to correspond to an RGBW pixel structure through a sub-pixel rendering method and a direct rendering method. FIG. 4 shows comparison between the sub-pixel rendering method and the direct rendering method for the original image data as shown in FIG. 3. In FIG. 4, the x-axis represents pixel positions and the y-axis represents data values (or grayscale values).

Referring to FIGS. 3 and 4, an input image data is composed of an RGB pixel data and converted into an RGBW pixel data to correspond to an RGBW pixel structure of a display device.

The input image data includes first to third RGB pixel data from the left in FIGS. 3 and 4. The first and third RGB pixel data are a black grayscale data having red, green and blue sub-pixel data corresponding to a data value of 0. The second RGB pixel data is a white grayscale data having red, green and blue sub-pixel data corresponding to a data value of 255.

As described above, according to the sub-pixel rendering method, a plurality of input pixel data Pi related to a target pixel are reflected in the target pixel data. As a result, data values of the converted image data are widely spread at a text edge, and the sub-pixel rendering method can thus reduce or minimize data loss even in the case of a chromatic data in which a data of one or more colors is not present. This is because neighboring data related to the target pixel are reflected in the target pixel data, which depends on the area ratios of the neighboring data when the input image data is rendered. Accordingly, the sub-pixel rendering method can represent a chromatic text data closer to its original image, that is, the input image, as compared to the direct rendering method. In the sub-pixel rendering method, an edge of the rendered text may be blurred due to a small difference in data values.

On the contrary, as described above, the direct rendering method selects a data value of an input pixel data having its center point closest to a center point of the target pixel as the target pixel data. Accordingly, a spread width of the converted image data is narrow at a text edge. In the case of a chromatic data, when an input image data is rendered using the direct rendering method, a black grayscale data is selected as the target data, and thus, black dots, which may not be present in the input image, may be seen. In the case of an achromatic text having no color difference, the direct rendering method can represent a text edge line close to the input image without black dots since the colors of RGB pixel data have an identical data value or similar data values. Accordingly, it may be desirable to render an achromatic text data using the direct rendering method.

According to an embodiment of the present invention, the target pixel data converted through the sub-pixel rendering method or the direct rendering method is respectively multiplied by weights and adaptively varies the weights on a basis of a degree of saturation of an input pixel data. As a result, the legibility of both achromatic and chromatic text data can be improved by increasing a direct rendering application ratio for the achromatic text data and by increasing a sub-pixel rendering application ratio for the chromatic text data.

Figure 5:
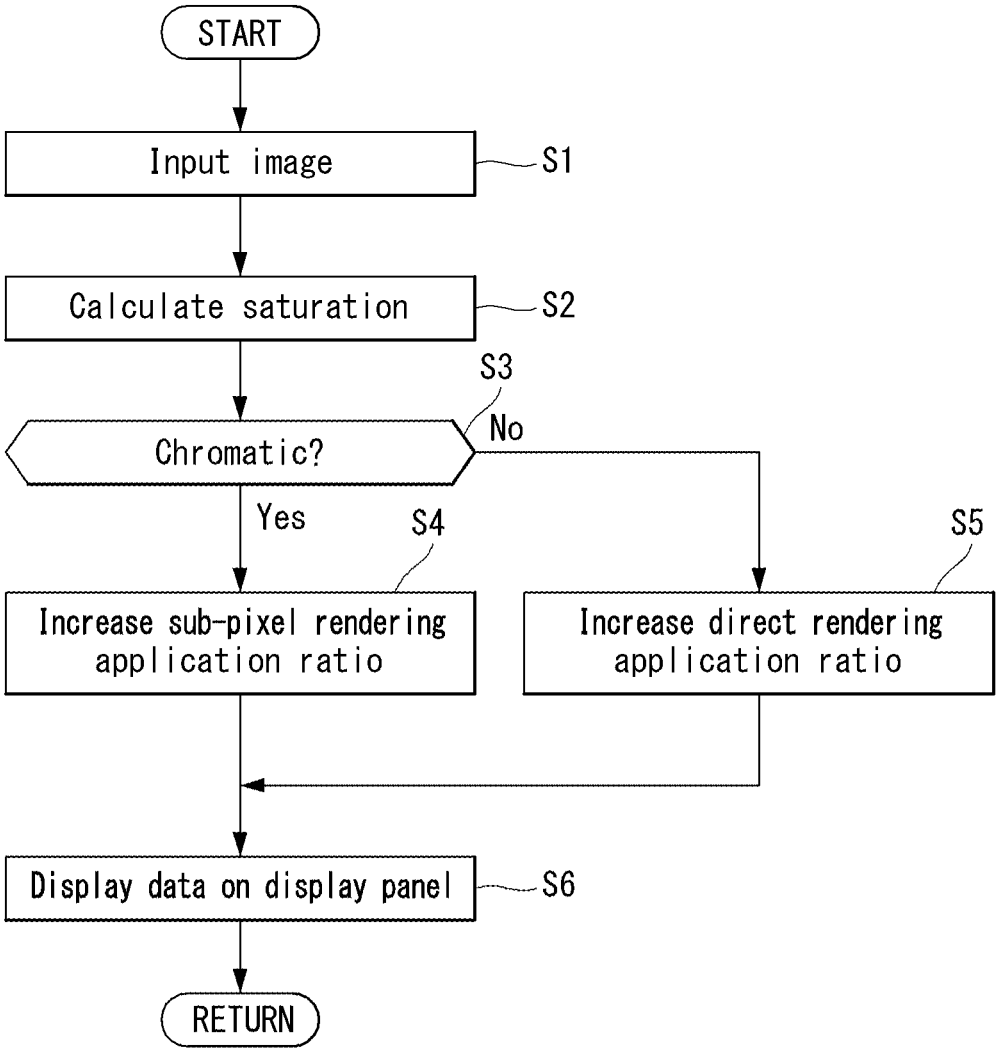
FIG. 5 is a flowchart illustrating an image rendering method of a display device according to an embodiment of the present invention.

FIG. 5 is a flowchart illustrating an image rendering method of a display device according to an embodiment of the present invention.

Referring to FIG. 5, the image rendering method calculates a degree of saturation of each pixel data of an input image (S1 and S2). Any known method can be used as a method of calculating a degree of saturation. For example, a degree of saturation can be calculated as follows.

$$Pixel_{saturation} = 0, \quad \text{if } \max(RGB) = 0$$

$$1 - \frac{\min(RGB)}{\text{mean}(RGB)}, \qquad \text{otherwise.}$$

Here, "$\text{Pixel}_{saturation}$" indicates a degree of saturation of pixel data, and "max(RGB)" indicates a maximum value from among a red sub-pixel data R, a green sub-pixel data G and a blue sub-pixel data B. In addition, "min(RGB)" represents a minimum value from among the red sub-pixel data R, the green sub-pixel data G and the blue sub-pixel data B, and "mean(RGB)" represents a mean value of the red sub-pixel data R, the green sub-pixel data G and the blue sub-pixel data B.

As another example of the saturation calculation method, a data can be determined as a high-saturation data $\text{Pixel}_{saturation}$ when a difference between the maximum value max(R,G,B) and the minimum value min(R,G,B) of the red sub-pixel data R, the green sub-pixel data G and the blue sub-pixel data B of the corresponding data is large. Alternatively, a degree of saturation can be calculated using a transform formula for converting an RGB color space into a HIS (Hue, Intensity, Saturation) or HSV (Hue, Saturation, Value) color space.

$$\text{Pixel}_{saturation} = \max(R,G,B) - \min(R,G,B).$$

In a sub-pixel rendering algorithm, a plurality of input pixel data of the original image can be reflected in one piece of target data after conversion. In this case, the highest saturation value of a plurality of pixels can be selected as a representative saturation value of the corresponding pixels.

The image rendering method according to an embodiment of the present invention increases a sub-pixel rendering application ratio when the input image pixel data is a chromatic data (S3 and S4). The sub-pixel rendering application ratio increases as a degree of saturation increases. The image rendering method according to an embodiment of the present invention increases a direct rendering application ratio when the input image pixel data is close to an achromatic data (S4 and S5). The direct rendering application radio increases as a degree of saturation decreases. Steps S4 and S5 can be implemented as a method of controlling a weight $\alpha$ according to a degree of saturation, as illustrated in FIG. 6.

A converted image data rendered through the image rendering method is transmitted to a display panel driving circuit. The display panel driving circuit writes the converted image data to pixels of the display panel to display the input image on the display panel (S6).

Figure 6:
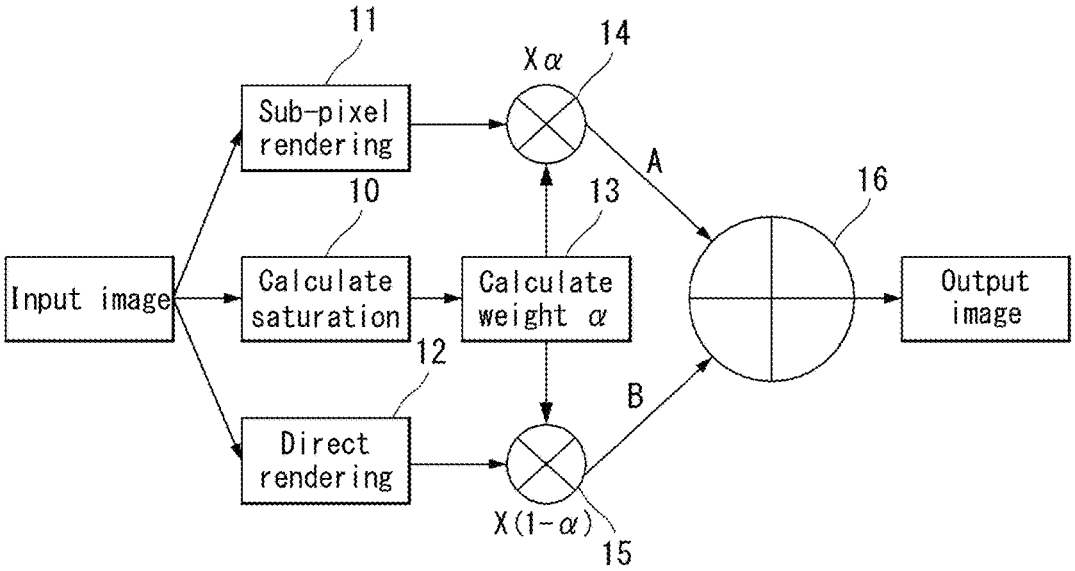
FIG. 6 illustrates an image rendering device according to an embodiment of the present invention.
Figure 7:
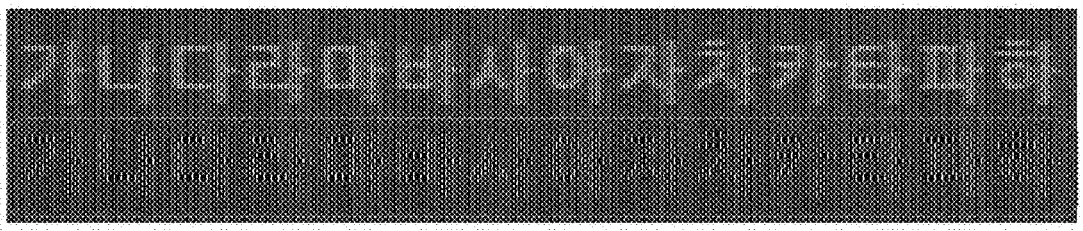
FIG. 7 illustrates an example in which the sub-pixel rendering method is applied to chromatic text data and an example in which the direct rendering method is applied to achromatic text data.
Figure 7:
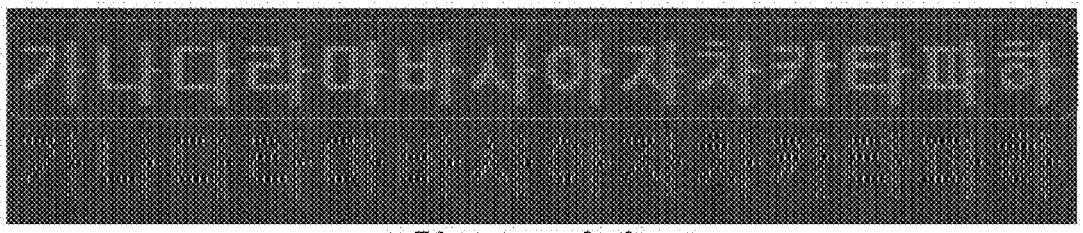

FIG. 6 illustrates an image rendering device according to an embodiment of the present invention, and FIG. 7 shows an example in which a sub-pixel rendering method is applied to a chromatic text data and an example in which a direct rendering method is applied to an achromatic text data.

Referring to FIGS. 6 and 7, the image rendering device according to an embodiment of the present invention includes a saturation calculation unit 10, a sub-pixel rendering processing unit 11, a direct rendering processing unit 12, a weight calculation unit 13, a first weight application unit 14, a second weight application unit 15 and an addition unit 16.

The saturation calculation unit 10 calculates a degree of saturation of each piece of pixel data of an input image. The sub-pixel rendering processing unit 11 adjusts values of a plurality of pieces of input image data related to a pixel according to an area ratio of the pixel and sums the data values to output a first target pixel data. The direct rendering processing unit 12 outputs an input image pixel data having a center point closest to a center point of the pixel as a second target pixel data.

The weight calculation unit 13 calculates a weight $\alpha$ in proportion to a saturation input from the saturation calculation unit 10. The weight calculation unit 13 calculates a weight $1-\alpha$ in inverse proportion to the saturation on a basis of the weight $\alpha$. The weight $\alpha$ becomes close to 1 as the saturation becomes close to 1. The weight α is generated as a value between 0 and 1 and varies according to a degree of saturation.

The first weight application unit 14 multiplies the first target pixel data by the weight α and outputs the multiplication result. The second weight application unit 15 multiplies the second target pixel data by the weight 1−α in inverse proportion to the saturation and outputs the multiplication result. Because "1−α" decreases as a increases and "1−α" increases as a decreases, a sub-pixel rendering application ratio increases according to the weight α and a direct rendering application ratio decreases as the sub-pixel rendering application ratio increases, in the case of a chromatic pixel data. Conversely, the direct rendering application ratio increases according to the weight α and the sub-pixel rendering application ratio decreases as the direct rending application ratio increases, in the case of an achromatic pixel data.

The addition unit 16 sums an output data A of the first weight application unit 14 and an output data B of the second weight application unit 15 and outputs the result. Image data output from the addition unit 16 is transmitted to the display panel driving circuit and written to the pixels of the display panel.

As shown in FIG. 7, when the direct rendering method is applied to a chromatic pixel data (second column), black dots are deepened. When a chromatic pixel data is converted through the sub-pixel rendering method, dots are not clearly seen and thus, a text edge line can be more clearly expressed compared to the direct rendering method. When the direct rendering method is applied to an achromatic pixel data (first column), the text edge line can be further clearly expressed, compared to the sub-pixel rendering method.

Figure 8:
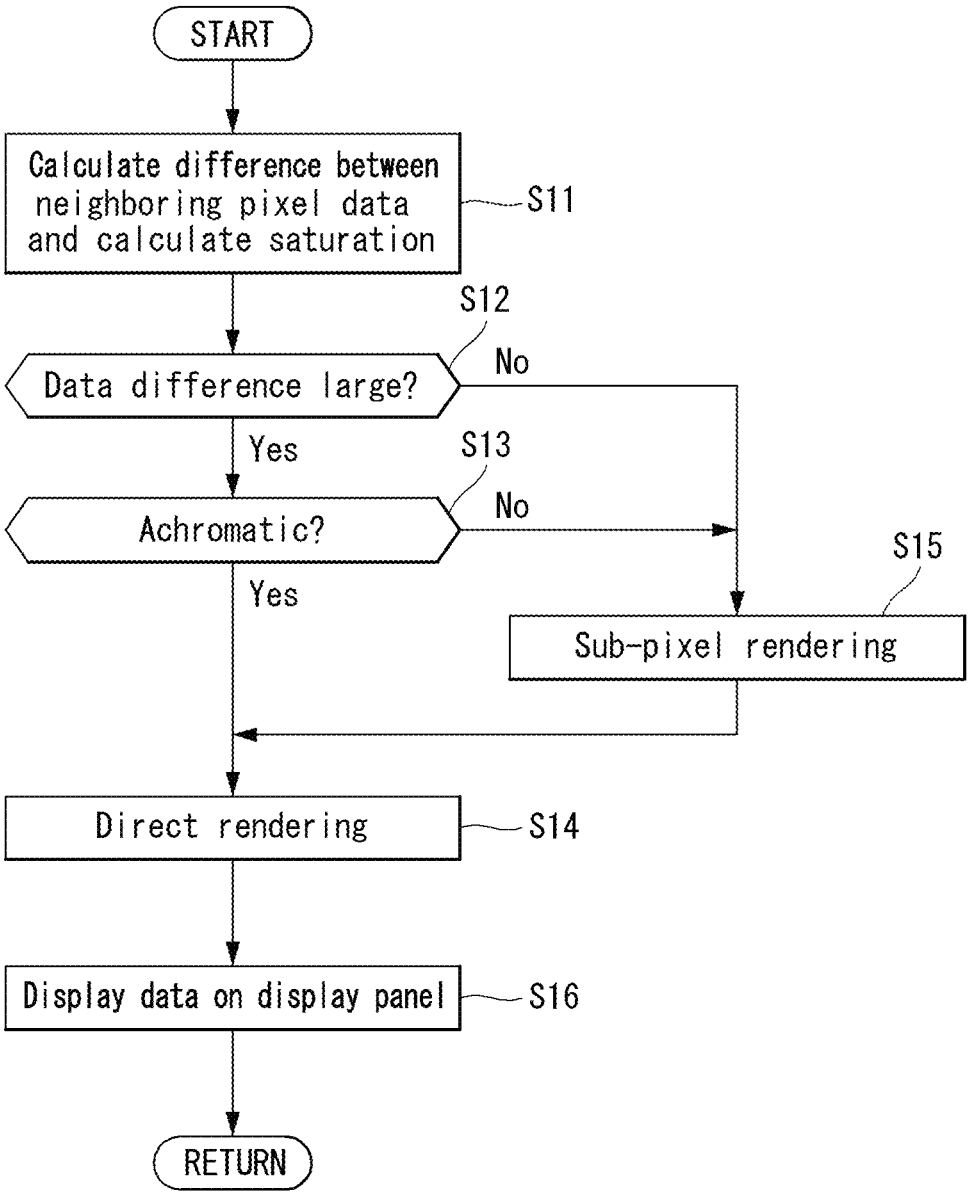
FIG. 8 is a flowchart illustrating an image rendering method of a display device according to another embodiment of the present invention.
Figure 9:
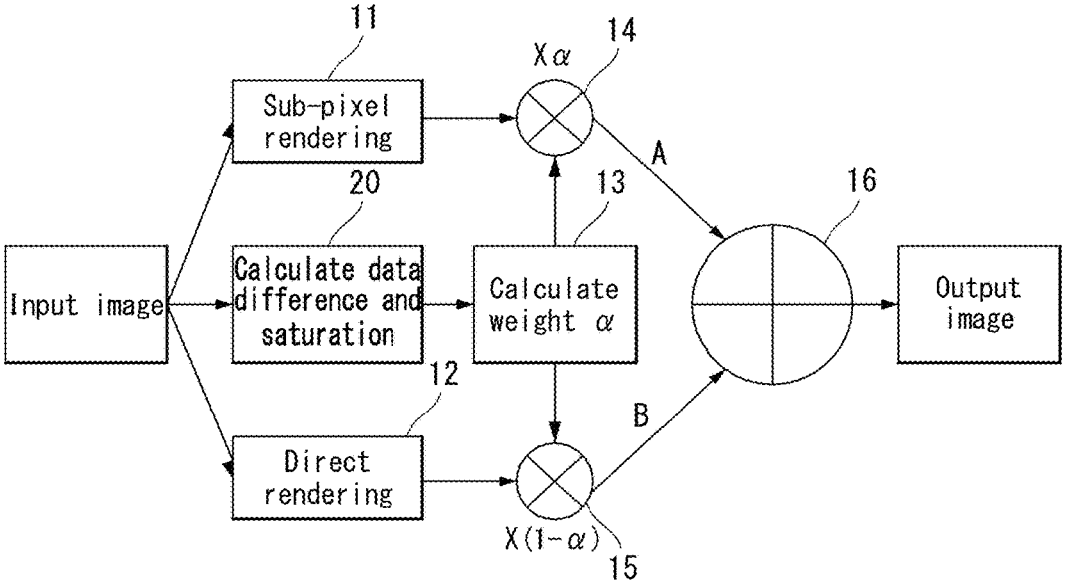
FIG. 9 illustrates an image rendering device according to another embodiment of the present invention.

The image rendering method according to an embodiment of the present invention can adaptively control the sub-pixel rendering application ratio and the direct rendering application ratio in consideration of neighboring pixel data values, as illustrated in FIGS. 8 and 9. When a difference between neighboring pixel data values is large, a direct rendering can improve text legibility compared to a sub-pixel rendering, as shown in FIG. 3. When a difference between neighboring pixel data values is small, a sub-pixel rendering can improve text legibility, as shown in FIG. 3.

FIG. 8 is a flowchart illustrating an image rendering method according to another embodiment of the present invention.

Referring to FIG. 8, the image rendering method calculates saturation of each piece of input image pixel data (S11 and S12). Any known method can be used as a method of calculating a degree of saturation.

The image rendering method according to another embodiment of the present invention calculates a difference between neighboring pixel data values. The image rendering method increases a direct rendering application ratio when a difference between neighboring pixel data values is large and the pixel data is an achromatic data (S13 and S14). The image rendering method increases a sub-pixel rendering application ratio when a difference between neighboring pixel data values is small and the pixel data is a chromatic data (S12 to S15). Steps S12 and S15 may be implemented as a method of controlling weight α according to a degree of saturation, as illustrated in FIG. 9.

A converted image data rendered through the image rendering method according to another embodiment of the present invention is transmitted to a display panel driving circuit. The display panel driving circuit writes the converted image data to the pixels of the display panel so as to display the input image on the display panel (S16).

FIG. 9 illustrates an image rendering device according to another embodiment of the present invention.

Referring to FIG. 9, the image rendering device according to another embodiment of the present invention includes a data difference & saturation calculation unit 20, a sub-pixel rendering processing unit 11, a direct rendering processing unit 12, a weight calculation unit 13, a first weight application unit 14, a second weight application unit 15 and an addition unit 16.

The data difference & saturation calculation unit 20 calculates a difference between neighboring pixel data values in an input image and saturation of each piece of pixel data of the input image. The sub-pixel rendering processing unit 11 adjusts values of a plurality of pieces of input image data related to a pixel according to an area ratio of the pixel and sums the data values to output a first target pixel data. The direct rendering processing unit 12 outputs an input image pixel data having its center point closest to a center point of the pixel as a second target pixel data.

The weight calculation unit 13 calculates a weight α which is inversely proportional to the data difference and proportional to the saturation, input from the data difference & saturation calculation unit 20. The weight calculation unit 13 calculates a weight 1−α which is proportional to the difference between neighboring pixel data values and inversely proportional to the saturation on a basis of the weight α. The weight α increases as the data difference decreases, and the saturation increases and decreases as the data difference increases and the saturation decreases, respectively. The weight α is generated as a value between 0 and 1 and varies according to the difference between neighboring pixel data values and the saturation.

The first weight application unit 14 multiplies the first target pixel data by the weight α and outputs the multiplication result. The second weight application unit 15 multiplies the second target pixel data by the weight 1−α in inverse proportion to saturation and outputs the multiplication result. Herein, 1−α decreases as a increases, whereas 1−α increases as a decreases.

The addition unit 16 sums an output data A of the first weight application unit 14 and an output data B of the second weight application unit 15 and outputs the result. An image data output from the addition unit 16 is transmitted to the display panel driving circuit and written to pixels of the display panel.

Figure 10:
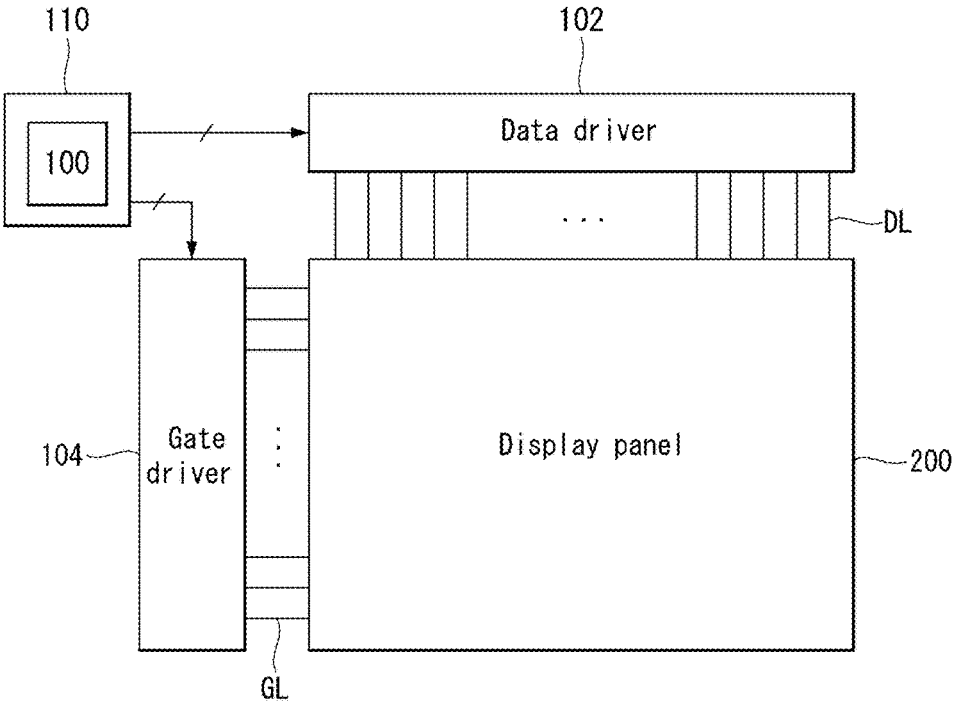
FIG. 10 illustrates a display device according to an embodiment of the present invention.

FIG. 10 illustrates a display device according to an embodiment of the present invention.

Referring to FIG. 10, the display device according to an embodiment of the present invention includes a display panel 200, a display panel driving circuit for writing input image pixel data to a pixel array of the display panel 200 and an illumination sensor (not shown).

The display panel driving circuit includes a data driver 102, a gate driver 104 and a timing controller 110. The display panel driving circuit writes the pixel data (or target data) converted by the image rendering device to pixels.

In the pixel array of the display panel 200, a plurality of data lines DL intersects a plurality of scan lines (or gate lines) GL and pixels are arranged in a matrix. An input image pixel data is converted through the aforementioned image rendering method and displayed on the pixel array. Each pixel includes a sub-pixel R, a sub-pixel G and a sub-pixel B. Each pixel may further include a sub-pixel W.

The data driver 102 converts the pixel data received from the timing controller 110 into an analog gamma compensation voltage to generate a data voltage and outputs the data voltage to the data lines DL. The pixel data input to the data driver 102 is a digital video data of the input image.

The gate driver 104 supplies a scan pulse (or gate pulse) synchronized with the output voltage of the data driver 102 to the scan lines GL under the control of the timing controller 110. The gate driver 104 sequentially shifts the scan pulse per line to sequentially select pixels to which data is written.

The timing controller 110 includes an image rendering device 100 as illustrated in FIGS. 6 and 9. The image rendering device 100 adaptively varies a sub-pixel rendering application ratio and a direct rendering application ratio in consideration of a degree of saturation of an input image and a difference between neighboring data values, as described above.

The timing controller 110 receives an input image pixel data and timing signals synchronized with the input image pixel data from a host system (not shown). The timing signals include a vertical synchronization signal Vsync, a horizontal synchronization signal Hsync, a data enable signal DE and the like. The timing controller 110 transmits a data output from the image rendering device 100 to the data driver 102.

The timing controller 110 controls an operation timing of the data driver 102 and the gate driver 104 on a basis of the timing signals synchronized with the input image pixel data and input thereto. The timing controller 110 generates a data timing control signal and a gate timing control signal on a basis of the timing signals so as to synchronize the data driver 102 with the gate driver 104. The data timing control signal defines an operation timing and an output timing of the data driver 102. The gate timing control signal defines an operation timing and an output timing of the gate driver 104.

The host system may be implemented by one of a TV system, a set-top box, a navigation system, a DVD player, a Blu-ray player, a personal computer, a home theater system, a phone system, and the like.

As described above, the legibility of achromatic and chromatic text data can be improved, for example, by increasing a direct rendering application ratio for the achromatic text data and increasing a sub-pixel rendering application ratio for the chromatic text data.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be apparent to those skilled in the art that various modifications and variation can be made in the present invention without departing from the concepts and scope of the invention. Thus, it is intended that the present invention cover the modifications and variations of this invention provided they come within the scope of the appended claims and their equivalents.

What is claimed is:

1. A display device, comprising a display panel in which data lines intersect scan lines and pixels are arranged in a matrix form;

an image rendering device for calculating saturation of each piece of pixel data of an input image, adjusting a sub-pixel rendering application ratio and a direct rendering application ratio for the pixel data using a weight in proportion to the saturation and converting the pixel data; and a display panel driving circuit for writing data converted by the image rendering device to the pixels of the display panel, wherein sub-pixel rendering adjusts values of input image pixel data related to a pixel according to an area ratio of the pixel, sums the pixel data values and converts the pixel data into data to be written to the pixel, wherein direct rendering selects pixel data having a center point closest to the center point of the pixel from among the pixel data and converts the selected pixel data into data to be written to the pixel, wherein the direct rendering application ratio is decreased by a sub-pixel rendering application ratio increase, and the sub-pixel rendering application ratio is reduced by a direct rendering application ratio increase.

2. The display device of claim 1, wherein the image rendering device increases the sub-pixel rendering application ratio and decreases the direct rendering application ratio when the pixel data is chromatic data, the image rendering device increasing the direct rendering application ratio and decreasing the sub-pixel rendering application ratio when the pixel data is achromatic data.

3. The display device of claim 2, wherein the image rendering device comprises:

a saturation calculation unit for calculating saturation of each piece of pixel data of the input image;

a sub-pixel rendering processing unit for converting the pixel data through sub-pixel rendering to output first target pixel data;

a direct rendering processing unit for converting the pixel data through direct rendering to output second target pixel data;

a weight calculation unit for calculating a first weight $\alpha$ in proportion to the saturation and calculating a second weight $1-\alpha$ in inverse proportion to the saturation on the basis of the first weight;

a first weight application unit for multiplying the first target pixel data by the first weight $\alpha$ and outputting a multiplication result;

a second weight application unit for multiplying the second target pixel data by the second weight $1-\alpha$ and outputting a multiplication result; and an addition unit for summing output data of the first weight application unit and output data of the second weight application unit and transmitting a sum result to the display panel driving circuit, wherein the weight $\alpha$ in proportion to the saturation is generated as a value between 0 and 1 and varied in proportion to the saturation.

4. The display device of claim 1, wherein the image rendering device calculates a difference between neighboring pixel data values in the input image, adjusts a sub-pixel rendering application ratio and a direct rendering application ratio for the pixel data by varying the weight on the basis of the difference and converts the pixel data.

5. The display device of claim 1, wherein the image rendering device increases the direct rendering application ratio and decreases the sub-pixel rendering application ratio when the difference between neighboring pixel data values is large and the pixel data is achromatic data, wherein the image rendering device increases the sub-pixel rendering application ratio and decreases the direct rendering application ratio when the difference between neighboring pixel data values is small or the pixel data is chromatic data.

6. The display device of claim 5, wherein the image rendering device comprises:

a data difference & saturation calculation unit for calculating a difference between neighboring pixel data values in the input image and saturation of each piece of pixel data of the input image;

a sub-pixel rendering processing unit for converting the pixel data through sub-pixel rendering to output first target pixel data;

a direct rendering processing unit for converting the pixel data through direct rendering to output second target pixel data;

a weight calculation unit for calculating a first weight $\alpha$ inversely proportional to the difference between neighboring pixel data values and proportional to the saturation and calculating a second weight $1-\alpha$ proportional to the difference between neighboring pixel data values and inversely proportional to the saturation on the basis of the first weight;

a first weight application unit for multiplying the first target pixel data by the first weight $\alpha$ and outputting a multiplication result;

a second weight application unit for multiplying the second target pixel data by the second weight $1-\alpha$ and outputting a multiplication result; and an addition unit for summing output data of the first weight application unit and output data of the second weight application unit and transmitting a sum result to the display panel driving circuit, wherein the weight $\alpha$ in proportion to the saturation is generated as a value between 0 and 1 and varied in proportion to the difference between neighboring pixel data values and the saturation.

7. An image rendering method of a display device having data lines, scan lines intersecting the data lines, and pixels arranged in a matrix form, comprising:

calculating saturation of each piece of pixel data of an input image, adjusting a sub-pixel rendering application ratio and a direct rendering application ratio for the pixel data using a weight in proportion to the saturation and converting the pixel data, wherein sub-pixel rendering adjusts values of input image pixel data related to a pixel according to an area ratio of the pixel, sums the pixel data values and converts the pixel data into data to be written to the pixel, wherein direct rendering selects pixel data having a center point closest to the center point of the pixel from among the pixel data and converts the selected pixel data into data to be written to the pixel, wherein the direct rendering application ratio is decreased by a sub-pixel rendering application ratio increase, and the sub-pixel rendering application ratio is reduced by a direct rendering application ratio increase.

8. The image rendering method of claim 7, wherein the converting of the pixel data comprises:

increasing the sub-pixel rendering application ratio and decreasing the direct rendering application ratio using the weight when the pixel data is chromatic data; and increasing the direct rendering application ratio and decreasing the sub-pixel rendering application ratio when the pixel data is achromatic data.

9. The image rendering method of claim 7, further comprising calculating a difference between neighboring pixel data values in the input image, adjusting a sub-pixel rendering application ratio and a direct rendering application ratio for the pixel data by varying the weight on the basis of the difference and converting the pixel data, wherein the direct rendering application ratio is increased and the sub-pixel rendering application ratio is decreased when the difference between neighboring pixel data values is large and the pixel data is achromatic data, wherein the sub-pixel rendering application ratio is increased and the direct rendering application ratio is decreased when the difference between neighboring pixel data values is small or the pixel data is chromatic data.

* * * * *